US008776906B2

(12) United States Patent
Char

(10) Patent No.: US 8,776,906 B2
(45) Date of Patent: Jul. 15, 2014

(54) SYSTEM AND METHOD FOR PREVENTING THE INCIDENCE OF FOREST FIRES OVER LARGE AREAS

(76) Inventor: Srirangapatnam A. Char, Bangalore (IN)

( * ) Notice: Subject to any disclaimer, the term of this patent is extended or adjusted under 35 U.S.C. 154(b) by 979 days.

(21) Appl. No.: 12/425,460

(22) Filed: Apr. 17, 2009

(65) Prior Publication Data

US 2009/0266565 A1 Oct. 29, 2009

Related U.S. Application Data

(60) Provisional application No. 61/047,125, filed on Apr. 23, 2008.

(51) Int. Cl.

| | |
|---|---|
| ***A62C 3/02*** | (2006.01) |
| ***A62C 35/11*** | (2006.01) |
| ***A62C 35/02*** | (2006.01) |
| ***A62C 35/00*** | (2006.01) |
| ***A62C 2/00*** | (2006.01) |
| ***A62C 37/40*** | (2006.01) |
| ***A62C 37/36*** | (2006.01) |

(52) U.S. Cl.

USPC ..... 169/61; 169/13; 169/45; 169/56; 169/60; 239/69; 700/283

(58) Field of Classification Search

USPC ..... 169/43, 45, 46, 5, 16, 48, 56, 60, 61; 239/67, 69; 222/54; 700/283, 284; 340/521, 522, 540, 584, 588, 589, 601, 340/602

See application file for complete search history.

(56) References Cited

U.S. PATENT DOCUMENTS

| | | | | |
|---|---|---|---|---|
| 3,844,481 | A * | 10/1974 | Livingston | 239/727 |
| 4,311,199 | A * | 1/1982 | Elias | 169/48 |
| 5,749,521 | A * | 5/1998 | Lattery | 239/64 |
| 5,931,233 | A * | 8/1999 | La Bonte et al. | 169/5 |
| 5,944,114 | A * | 8/1999 | Farley | 169/48 |
| 7,363,112 | B2 * | 4/2008 | Cartwright | 700/284 |
| 7,574,284 | B2 * | 8/2009 | Goldberg et al. | 700/284 |
| 2004/0244996 | A1 * | 12/2004 | Kravkov | 169/5 |
| 2005/0045228 | A1 * | 3/2005 | Labrador | 137/357 |
| 2006/0176169 | A1 * | 8/2006 | Doolin et al. | 340/521 |
| 2007/0044978 | A1 * | 3/2007 | Cohen | 169/5 |
| 2008/0097653 | A1 * | 4/2008 | Kaprielian et al. | 700/284 |
| 2009/0151961 | A1 * | 6/2009 | Voorhees | 169/13 |

* cited by examiner

*Primary Examiner* — Darren W Gorman
(74) *Attorney, Agent, or Firm* — Klarquist Sparkman, LLP

(57) ABSTRACT

A wildfire prevention system is described. The system includes a data measurement station for measuring environmental factors relevant for determining the likelihood of a wildfire in a prescribed area, a control station configured to receive data measured by the data measurement station and to determine the likelihood of a wildfire by comparison of the data received with predetermined data values representing likelihood of a wildfire, the predetermined data values including data values for each of the environmental factors individually and in combination with other environmental factors, and a moisture induction system including a water reservoir, configured for induction of moisture in the prescribed area on activation by the control station on the determination of the likelihood of a wildfire in the prescribed area. A method of preventing a wildfire is also described.

13 Claims, 3 Drawing Sheets

SYSTEM AND METHOD FOR PREVENTING THE INCIDENCE OF FOREST FIRES OVER LARGE AREAS

CROSS-REFERENCE TO RELATED APPLICATIONS

This application claims the benefit of U.S. Provisional Application No. 61,047,125, filed on Apr. 23, 2008. The entire disclosure of the above application is incorporated herein by reference.

FIELD

The present disclosure relates to a system and method for preventing the incidence of wildfires over large areas.

BACKGROUND

Each year, a number of countries across the globe face the devastating effect caused by forest fires or wild fires. Forest fires cause huge economic losses by damaging valuable property as well as other valuable resources. In addition, huge sums of money are spent each year on fire fighting and evacuation of people to safe places. In the USA for example, during the month of October 2007 an area of 2090 square kilometers in southern California was burnt by wild fires and over $1 billion was spent on fire suppression. More than 340,000 homes in the stretch from San Diego to Los Angeles were evacuated and about half a million people were affected. Forest fires also have a devastating effect on the environment. A large quantity of carbon-dioxide and other noxious gases that are emitted during forest fires cause pollution and contribute to the green-house effect leading to global warming. It has been observed that restoration of the ecosystem in the area devastated by forest fire especially those closer to urban areas is difficult leading to further shrinkage of woodlands.

The effect of a forest fire is often wide spread and not limited to the physical boundaries of the forest fire. By way of example, some years ago the forest fires in Indonesia blanketed the whole of Singapore with smoke for many days disrupting normal life and forced people to wear breathing masks outdoors.

Over the years, the frequency and the extent of wild fires have increased. Some major factors that contribute to this increase are various human activities. As encroachment of wild land increases, the risk of wild fires in areas that were earlier considered to be safe has also increased.

Forest fires are generally caused by rise in temperature as well as low moisture levels in the atmosphere and in the soil during summer and dry seasons. The fires quickly spread to large areas often on account of winds.

Conventionally, forest fires or wild fires are controlled by prescribed burning of designated forest areas. But prescribed fires are controversial and are opposed by private land owners and timber businesses. It is also not possible to use this method in areas that are near human habitat. In addition, at times it may become difficult to control the extent of such fires and, prescribed fires are not always practical and effective solutions to control forest fires.

Some available systems to extinguish fires use temperature sensors that indicate fires, which in turn activate sprinklers around houses that extinguish the fire. However, these systems only provide protection against small local fires and are not useful in fighting large fires often advancing rapidly due to high winds. Moreover, most of these systems use municipal water from urban water supply systems making them uneconomical to use for fighting fire on a large scale. Most of these consider only the temperature aspect, but other environmental aspects also need to be taken into account. Moreover, such systems do not attempt to prevent the fire, but rather focus on putting out or containing the fire.

Therefore, there is a need to develop a wildfire prevention system that is economical and effective against large wild fires and takes into consideration all relevant environmental factors responsible for wildfires.

SUMMARY

In one aspect, the present disclosure is directed to a wildfire prevention system that includes a data measurement station for measuring environmental factors relevant for determining the likelihood of a wildfire in a prescribed area, a control station configured to receive data measured by the data measurement station and to determine the likelihood of a wildfire by comparison of the data received with predetermined data values representing likelihood of a wildfire, the predetermined data values including data values for each of the environmental factors individually and in combination with other environmental factors, and a moisture induction system including a water reservoir, configured for induction of moisture in the prescribed area on activation by the control station on the determination of the likelihood of a wildfire in the prescribed area.

In another aspect, the present disclosure is directed to a wildfire prevention system that includes a moisture induction system configured for induction of moisture in a prescribed area including a data measurement station for measuring environmental factors relevant for determining the likelihood of a wildfire in a prescribed area, a control station configured to receive data measured by the data measurement station and to determine the likelihood of a wildfire by comparison of the data received with predetermined data values representing likelihood of a wildfire, the predetermined data values including data values for each of the environmental factors individually and in combination with other environmental factors, and a sprinkler system connected to water reservoir; the sprinkler system configured to be activated by the control station on the determination of the likelihood of a wildfire in the prescribed area, the data measurement station and the control station are integrally formed with the sprinkler system and placed in the prescribed area, and surface drains to collect excess moisture induced by the moisture induction system, the surface drains configured to send the excess moisture back to the water reservoir.

In another aspect, the present disclosure is directed to method of preventing a wildfire in a prescribed area that includes maintaining moisture level of the prescribed area at a predetermined level, the method comprising measuring environmental factors relevant for determining the likelihood of a wildfire in a prescribed area, determining the likelihood of a wildfire in the prescribed area, the method including comparing the data measured with predetermined data values representing likelihood of a wildfire, the predetermined data values including data values for each of the environmental factors individually and in combination with other environmental factors, and introducing into the prescribed area when the environmental conditions measured for the prescribed area indicate the likelihood of a wildfire in the prescribed area.

BRIEF DESCRIPTION OF DRAWINGS

The accompanying drawings illustrate the preferred embodiments of the invention and together with the following detailed description serves to explain the principles of the invention.

DETAILED DESCRIPTION OF DRAWINGS

Figure 1:
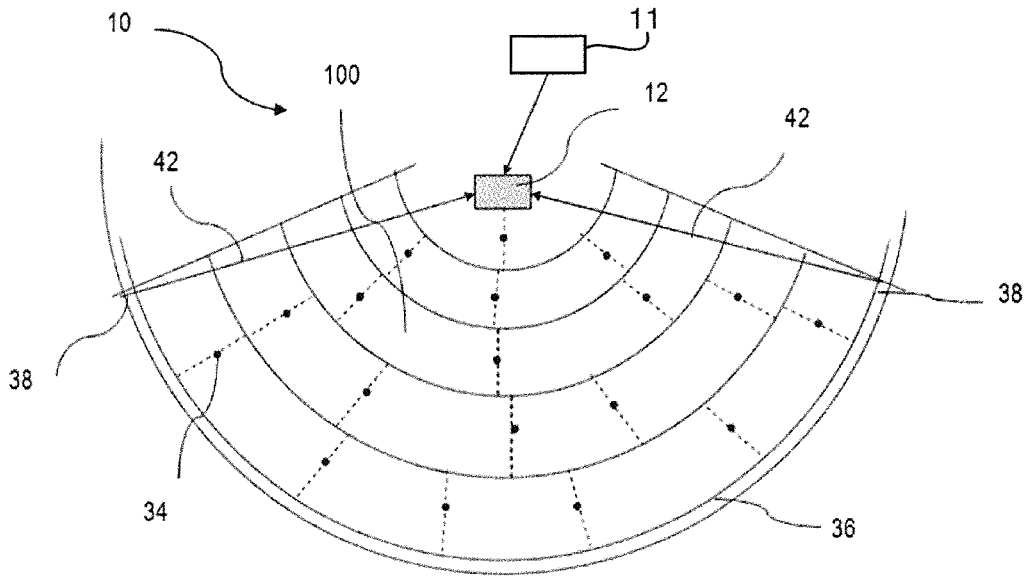
FIG. 1 is a schematic illustration of a wildfire prevention system in accordance with an embodiment.
Figure 2:
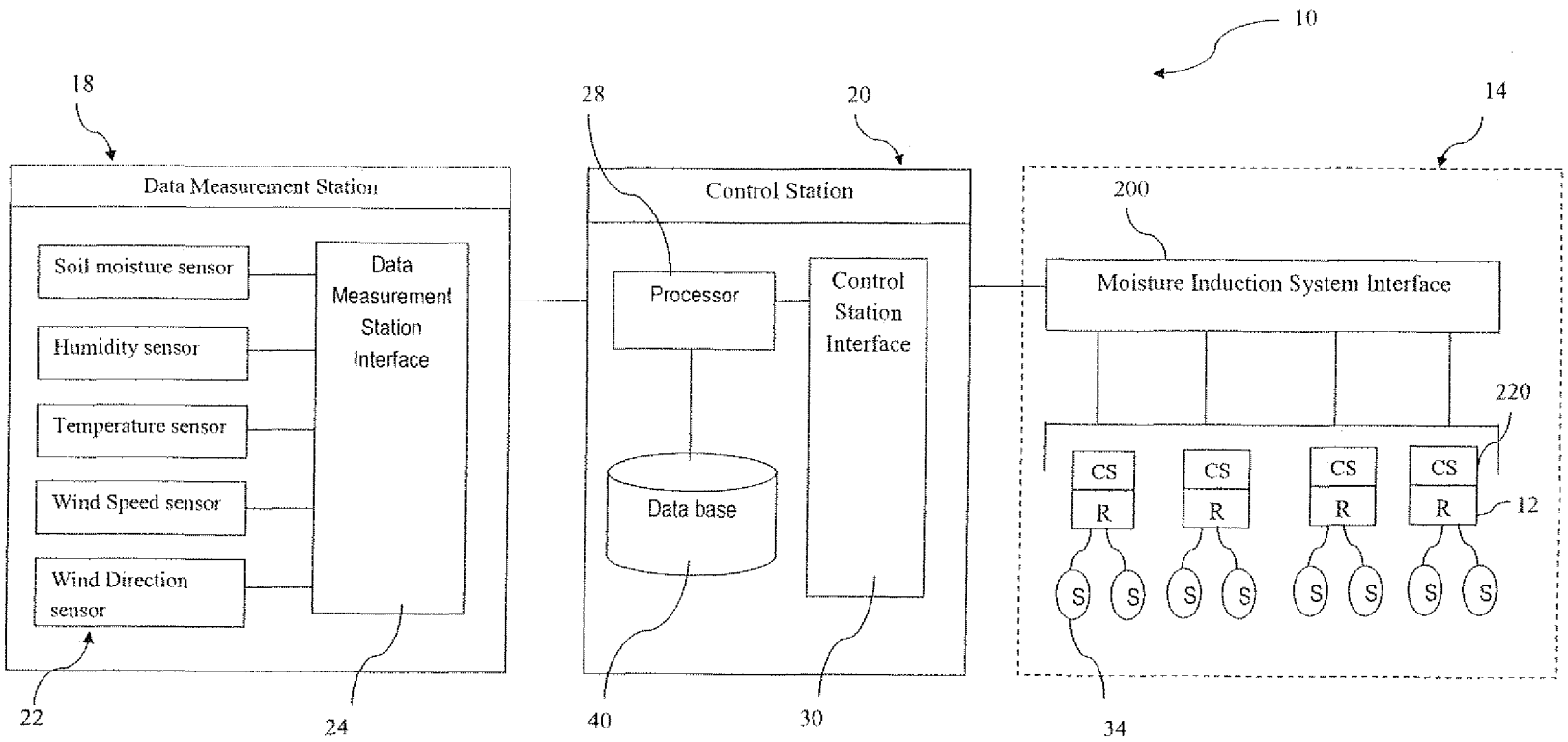
FIG. 2 is a schematic illustration of a wildfire prevention system in accordance with an embodiment.

With reference to FIGS. 1 and 2, a wildfire prevention system (10) in accordance with an embodiment for a hilly terrain is illustrated. The wildfire prevention system (10) comprises of a moisture induction system (14) including a water reservoir (12), a data measurement station (18) and a control station (20). The moisture induction system (14) maintains moisture level of a prescribed area (100) at a predetermined level by introducing moisture into the prescribed area (100). The data measurement station (18) measures environmental factors relevant for determining the likelihood of a wildfire in the prescribed area (100). If the environmental factors measured by the data measurement station (18) indicate the likelihood of a wildfire in the prescribed area (100) the moisture induction system (14) is activated by the control station (20) and moisture is induced into the prescribed area (100), which minimises the risk of a wildfire. Excess water induced by the moisture induction system (14) is collected at the boundary of the prescribed area by surface drains (36) and sent back to the water reservoir (12).

The wildfire prevention system (10) consists of at least one data measurement station (18) connected to the control station (20). In the embodiment illustrated a single data measurement station (18) is connected to the control station (20). The data measurement station (18) may be located in the prescribed area (100) while the control station (20) may be located at a safe place, away from the prescribed area (100). In accordance with an aspect, data measurement stations (18) may also be located in areas surrounding the prescribed area (100).

At the data measurement station (18), a cluster of sensors (22) is installed, to measure various environmental factors relevant for determining the likelihood of a wildfire in real time. Such sensors (22) include but are not limited to relative humidity sensors, soil moisture sensors, evaporation measuring devices, wind speed indicators, wind direction indicators, and temperature sensors. The sensors (22) continuously measure various environmental factors such as humidity, soil moisture, temperature, wind speed, and wind direction in the prescribed area (100) relevant for determining the likelihood of wildfire in the prescribed area (100). In the embodiment illustrated in FIG. 2, relative humidity sensor, soil moisture sensors, temperature sensor, wind speed indicators and wind direction indicators are installed. The data collected by the sensors (22) in real time is transmitted to a data measurement station interface (24). The data measurement station interface (24) collects the values gathered by sensors (22) and converts them into engineering values. These values are then transmitted to the control station (20).

The data transmitted by the data measurement station (18) is received by a processor (28) of the control station (20). The processor (28) of the control station (20) analyses the data received from the data measurement station (18) and assesses if environmental factors measured by the data measurement station (18) indicate a likelihood of a wildfire in the prescribed area (100).

Various environmental factors may be considered while assessing the likelihood of wildfire in the prescribed area. Such environmental factors include but are not limited to temperature, relative humidity, soil moisture, evaporation rate, wind speed and direction. To determine the likelihood of a wildfire the control station (20) compares the data measured by the data measurement station (18) with predetermined data values representing likelihood of a wildfire stored in a database (40). Values of all or some of the environmental factors may be considered in combination with each other. For example the value of relative humidity, soil moisture, temperature, wind speed and direction may be considered together to determine the likelihood of a wildfire in the prescribed area (100).

Alternatively, the value of each environmental factor may be considered independently in determining the likelihood of a wildfire in the prescribed area (100). By way of an example, relative humidity below a predetermined level or temperature above a predetermined level may be considered to indicate the likelihood of a wildfire in the prescribed area (100).

In accordance with an aspect, the predetermined values of environmental factors or the combination of environmental factors used for determining the likelihood of a wildfire in the prescribed area (100) may be set 10 to 20% below the actual values at which the environmental factor or the combination of environmental factors are likely to cause wildfire.

By way of a specific example, a combination of relative humidity less than 15%, soil moisture level less than 15% and temperature more than 85° F. may be considered to indicate the likelihood of a wildfire in the predefined area (100).

If environmental conditions of the prescribed area (100) indicate the likelihood of a wildfire in the prescribed area (100), the control station interface (30) communicates a command to a moisture induction system interface (200). The moisture induction system interface (200) in turn communicates the command to the control sensor (220) present at the water reservoir (12). The control sensors (220) on receiving the command activate the operation of the moisture induction system (14), and moisture is induced into the prescribed area (100).

In accordance with an aspect, the control station (20) may also be integrated with the data measurement station (18) and placed in the prescribed area.

Alternatively, the moisture induction system (14) may be directly connected to the sensors (22). In such embodiments, the moisture induction system (14), the data measurement station (18) and the control station (20) of the fire prevention system (10) are integrated. The sensors (22) attached to the moisture induction system (14) include but are not limited to sensors to measure humidity, soil moisture or temperature. The sensors (22) continuously measure environmental factors relevant for determining the likelihood of wildfire in the prescribed area (100). The environmental factors include but are not limited to relative humidity, soil moisture and temperature. The values collected by the sensors (22) are transmitted to the control station (20) that assesses the likelihood of wildfire in the prescribed area (100).

If the environmental conditions measured by the sensors (22) indicate the likelihood of a wildfire in the prescribed area the control station (20) activates the operation of the moisture induction system (14) and moisture is induced into the prescribed area.

In accordance with an aspect, the humidity sensor and the soil moisture sensor having a range of 5% to 100% with a resolution of 0.1% may be used. Any standard temperature sensor having a range for example of 40 degree Fahrenheit to 140 degree Fahrenheit with a resolution of 0.1 degree Fahrenheit may be used. The wind speed indicators used may have a range up to 150 miles per hour and the wind direction indicator may have a range of 0 to 360 degrees with a resolution of 0.1 degrees.

The moisture induction system (14) may be operated for a prescribed duration of time. Alternatively, moisture induction system (14) may be operated in a controlled manner, such that when the environmental factors measured by the data measurement station no longer indicate the likelihood of a wildfire in the prescribed area (100) the operation of the moisture induction system (14) is stopped. The sensors (22) at the data measurement stations (18) may be configured to continuously measure environmental factors such as the temperature, humidity, soil moisture level, and evaporation rate during the induction of moisture by the moisture induction system (14). If the environmental conditions measured by the data measurement station (18) indicate that the likelihood of a wildfire no longer exists in the prescribed area (100) the control station (20) sends a command to the moisture induction system interface (200) and the moisture induction system (14) is switched off by the control sensors (220).

In accordance with an aspect, the communication between the data measurement centre (18), the control station (20) and the moisture induction system (14) is via a satellite. By way of a specific example the data measurement station interface (24) is equipped with a satellite antenna that transmits the data measured by the sensors (22) to the control station (20) via satellite. The control station (20) is also equipped with satellite antenna for communicating with the data measurement station (18) and the moisture induction system (14). The satellite may be an independent system or existing weather satellite transmitters. It will however, be appreciated that any method for wireless communication may be used for communication between the data measurement station (18), control station (20) and the moisture induction system (14).

The water reservoir (12) provides water to the moisture induction system (14). The water reservoir (12) should have sufficient capacity to supply moisture to the moisture induction system (14) so as to bring the moisture level of the prescribed area (100) to a predetermined level. The water reservoir (12) may be a natural water reservoir such as river, lake, ocean or underground water reservoir that is directly connected to the moisture induction system (14).

Alternatively, the water reservoir (12) may be a man made water storage tank built in the prescribed area (100) that is supplied moisture from natural water reservoirs such as rivers, dams, lakes, underground water or recycled waste water from urban area. Lakes include both natural and man made lakes. The water reservoir (12) may also be supplied with sea water by pumping water from an ocean. In accordance with an aspect the sea water may be processed with a salt removal system (11), as shown in FIG. 1, to remove salt before being pumped into the water reservoir (12).

In accordance with an aspect, the water reservoir (12) may be filled with water only during the fire season or the months of the year during which conditions suitable for wildfire are present and not throughout the year. The water reservoir (12) may be built at higher ground levels in the prescribed area to allow water to be supplied to the moisture induction system (14) under gravity. For large areas, a plurality of water reservoirs (12) distributed to cover entire prescribed area (100) may be provided. By way of an example for an area of 20,000 acres, 30 water reservoirs having a capacity of one million gallons spaced one kilometer apart are required. The water reservoir may be a tank built of reinforced concrete cement without any top cover, 20 feet, deep 65 feet wide and 100 feet long, having a capacity of one million gallons. Each water reservoir is capable of inducing required moisture in an area of up to 700 acres. Each such reservoir may be supplied water from a nearby natural or manmade reservoir such as a lake, river, ocean or dam. Alternatively, rain water harvesting may be used.

In the embodiment illustrated in FIGS. 1 and 2, the moisture induction system (14) consists of a plurality of sprinklers (34) that are connected to the water reservoir (12). The sprinklers (34) are positioned to cover the entire prescribed area (100). In accordance with an aspect the sprinklers (34) are high pressure sprinklers that spray moisture at high pressures at different angles to cover all the trees and shrubs creating an artificial rain like situation in the area covered. By way of a specific example, the sprinklers (34) are big volume rain gun type models.

The water to the sprinkler (34) may be provided by gravity. The sprinklers (34) may also be provided with pumps to pump water from the water reservoir (12). In accordance with an aspect, the pumps may be located in underground protective chambers and have electrical connections through underground cables. Pumps may be equipped with stand-by power.

In accordance with an aspect, the pipes leading to the sprinklers (34) may be buried in the ground with sufficient cover. These pipes leading to the sprinklers (34) may be made of good polyvinyl chloride (PVC) or high-density polyethylene (HDPE) material. The pipes for the feeder mains and above ground pipes may be made of material such as ductile iron or galvanized iron, and should be capable of withstanding the required water pressure.

Part of the water induced by the moisture induction system (14) in the prescribed area (100) is re-circulated. For this purpose surface drains (36) may be provided in the prescribed area (100). Such surface drains (36) may be provided at the boundary of the prescribed area (100) at lower points. For example for a hilly terrain, surface drains (36) are provided at the bottom of the hill, as illustrated in FIG. 2. The excess water induced by the moisture induction system (14) flows into the surface drains (36) from where it is collected in sumps (38). The water collected in sumps (38) is sent to the water reservoir (12) by pumps and return pipes (42).

In accordance with an aspect barriers and deflectors may also be provided to help in preventing the spread of wildfire due to high winds. Such barriers may also be used to split a larger area into smaller areas. Such barriers and deflectors include but are not limited to wind barrier, water barrier or clay blankets. Such barriers or deflectors may be used alone or in combination.

Figure 3:
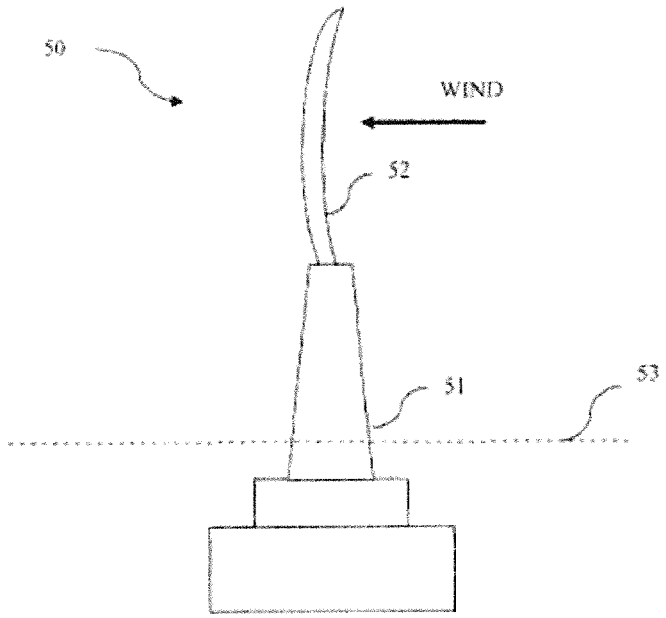
FIG. 3 illustrates a wind deflector in accordance with an embodiment.

FIG. 3 illustrates a wind deflector (50) in accordance with an embodiment. The wind deflector comprises of a base (51) and a deflector (52). The base (51) is built such that some portion of the base (51) is placed below the ground level (53). The base (51) anchors the wind deflector (50) to the ground. The deflector (52) is an arched structure integrally formed with the base (51). The deflector (52) is positioned such that the concave portion is positioned in the direction of the wind. By way of an example the wind deflector is made of reinforced concrete cement.

Figure 4:
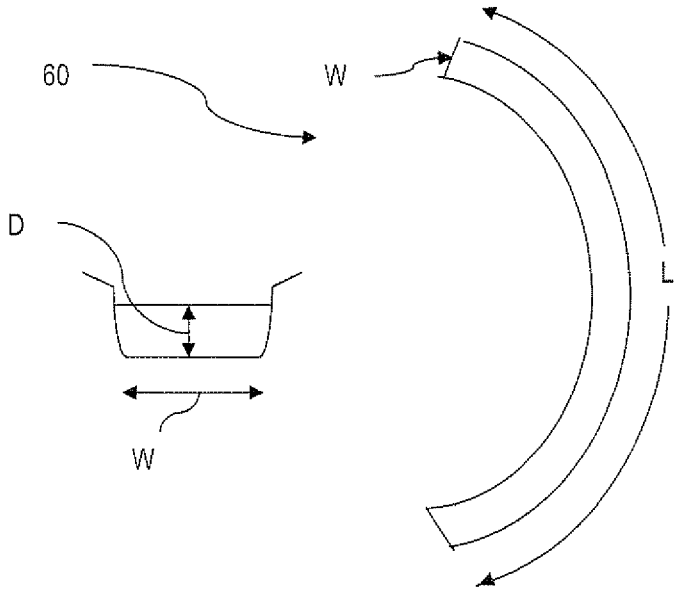
FIG. 4 illustrates a water barrier in accordance with an embodiment.

FIG. 4 illustrates a water barrier (60) in accordance with an embodiment. The water barrier is a shallow water channel of larger width (W) than depth (D) that is placed along the boundary of the area to be protected. By way of an example the water barrier may have a depth (D) of 2 to 3 feet and a width (W) of 30 to 150 feet. The water barrier helps in cooling down to small extent the approaching wildfire as well as provide a separation strip to divide the prescribed area into smaller areas.

In accordance with an aspect the clay blanket, or clay barrier, is a wide strip of clay material that is placed at a suitable position to divide the prescribed area into smaller areas. The barrier 60 shown at the right hand side of FIG. 4 can represent an outline of either a water barrier or clay barrier having a length L and width W. By way of an example the clay blanket may have a width W of 30 to 150 feet and a thickness of 1 to 2 feet.

In accordance with an aspect, the wildfire prevention system is provided with a monitoring and built-in check system to prevent any failure in the wildfire prevention system. The monitoring and build-in check system may be configured to permit the moisture induction system (14) to be activated manually.

A method for preventing a wildfire is described. The method comprises of maintaining the moisture level of the prescribed area (100) at a predetermined level, so as to reduce the likelihood of wildfires. The method comprises of measuring environmental factors that determine the likelihood of a wildfire in the prescribed area (100) and assessing if environmental conditions measured indicate the likelihood of a wildfire in the prescribed area (100). If the environmental factors indicate the likelihood of wildfire in the prescribed area (100), a moisture induction system (14) is activated to induce moisture into the prescribed area (100) to reduce the likelihood of a wildfire in the prescribed area (100). A part of the water induced is recycled by collecting the excess water in surface drain (36) and pumping it back to the moisture reservoir.

By way of a specific example, to prevent the likelihood of wildfire in the prescribed area 1500 gallons of water per acre is induced twice a day for two days per week during the fire season. For an area of 20,000 acres, 30 reservoirs having a capacity of one million gallons of water spaced one Kilometer apart are provided. Each acre is covered by 40 high pressure sprinklers each covering an area of 25 feet radius.

INDUSTRIAL APPLICABILITY

The system and method disclosed is simple and effective for preventing wildfires for a large area. The system is cost effective in that it uses raw untreated water from large natural water resources like dams, lakes, oceans and rivers instead of municipal water. Moreover, the system provides for recycling of the induced water which limits the quantity of water wasted to seepage and evaporation, while the rest (run-off) is saved for circulation. Approximately 30% to 50% of the water induced by the moisture induction system may be recycled, depending upon the terrain and soil type.

The capital costs of installing the wildfire prevention system disclosed is also relatively small as compared to the recurring costs of fire suppression, social effects of evacuation of people from their homes, ecological and health hazards, loss of property and business that result from wildfires. The operation and maintenance costs of the disclosed fire prevention system are small.

What is claimed is:

1. A wildfire prevention system comprising:

a data measurement station for measuring environmental factors relevant for determining the likelihood of a wildfire originating in a prescribed area;

a control station configured to receive data measured by the data measurement station and to determine the likelihood of a wildfire originating in the prescribed area by comparison of the data received with predetermined data values of the prescribed area stored in a database representing likelihood of a wildfire originating, wherein the predetermined data values of environmental factors or combination of environmental factors used for determining the likelihood of a wildfire in the prescribed area are set 10 to 20% below actual values at which the environmental factor or the combination of environmental factors are likely to cause wildfire;

a moisture induction system including a water reservoir, configured for induction of moisture in the prescribed area on activation by the control station on the determination that the likelihood of a wildfire originating in the prescribed area is greater than a predetermined threshold value; and a wind deflector to prevent a wildfire due to strong winds;

wherein the system is configured to maintain the prescribed area in a state such that a wildfire is unlikely to originate in the prescribed area throughout a fire season by induction of moisture in the prescribed area during times when the determined likelihood of a wildfire originating is greater than the predetermined threshold value.

2. A wildfire prevention system as claimed in claim 1, wherein the environmental factors relevant for determining the likelihood of a wildfire originating in the prescribed area include soil moisture, relative humidity, temperature, wind speed, or wind direction.

3. A wildfire prevention system as claimed in claim 1, wherein the control station is configured to stop the induction of moisture in the prescribed area when the environmental factors measured by the data measurement station no longer indicate the likelihood of a wildfire originating in the prescribed area.

4. A wildfire prevention system as claimed in claim 1, wherein the moisture induction system comprises of a plurality of sprinklers connected to the water reservoir.

5. A wildfire prevention system as claimed in claim 1, wherein the control station is placed outside the prescribed area.

6. A wildfire prevention system as claimed in claim 1, wherein the control station is integrated with the data measurement station and placed in the prescribed area.

7. A wildfire prevention system as claimed in claim 1, wherein the wildfire prevention system comprises of surface drains to collect excess moisture induced by the moisture induction system, the surface drains configured to send the excess moisture back to the water reservoir.

8. A wildfire prevention system as claimed in claim 1, further comprising a fire barrier.

9. A wildfire prevention system as claimed in claim 8, wherein the fire barrier comprises a water barrier or a clay barrier.

10. A system for preventing wildfires over a large area, comprising:

at least one data measurement station for measuring environmental factors relevant for determining the likelihood of a wildfire originating in a prescribed area when no wildfire is present;

a control station configured to receive data measured by the at least one data measurement station and to determine the likelihood of a wildfire originating in the prescribed area by comparison of the data received with predetermined data values of the prescribed area stored in a database representing likelihood of a wildfire originating, wherein the predetermined data values of environmental factors or combination of environmental factors used for determining the likelihood of a wildfire in the prescribed area are set 10 to 20% below actual values at which the environmental factor or the combination of environmental factors are likely to cause wildfire;

a plurality of water reservoirs;

a sprinkler system connected to the water reservoirs and configured to induce moisture throughout the prescribed area, the sprinkler system configured to be activated by the control station on the determination that a wildfire is likely to originate in the prescribed area;

surface drains to collect excess moisture induced by the sprinkler system, the surface drains configured to send the excess moisture back to the water reservoirs; and a wind deflector to prevent a wildfire due to strong winds;

wherein the system is configured to continuously maintain the prescribed area in a state such that a wildfire is unlikely to originate in the prescribed area.

11. The system of claim 10, wherein the system comprises at least 30 water reservoirs and the prescribed area comprises at least 20,000 acres.

12. The system of claim 10, wherein each water reservoir has a capacity of at least one million gallons.

13. The system of claim 10, wherein at least one of the water reservoirs is individually capable of inducing moisture over an area of 700 acres.

* * * * *